US008657010B2

(12) United States Patent
Ward et al.

(10) Patent No.: US 8,657,010 B2
(45) Date of Patent: Feb. 25, 2014

(54) DOWNHOLE FLOW DEVICE WITH EROSION RESISTANT AND PRESSURE ASSISTED METAL SEAL

(75) Inventors: Ryan Ward, Cypress, TX (US); Ron Williams, Houston, TX (US); Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 549 days.

(21) Appl. No.: 12/912,295

(22) Filed: Oct. 26, 2010

(65) Prior Publication Data

US 2012/0097386 A1 Apr. 26, 2012

(51) Int. Cl.
*E21B 34/00* (2006.01)

(52) U.S. Cl.
USPC ..... 166/320; 166/373

(58) Field of Classification Search
USPC ..... 166/373–375, 320, 332.1, 332.2, 321
See application file for complete search history.

(56) References Cited

U.S. PATENT DOCUMENTS

| | | | | |
|---|---|---|---|---|
| 2,317,021 | A | 4/1943 | Bassinger | |
| 2,853,265 | A | 9/1958 | Clark | |
| 2,888,080 | A | 5/1959 | Tausch et al. | |
| 3,051,243 | A | 8/1962 | Grimmer et al. | |
| 3,071,193 | A | 1/1963 | Raulins | |
| 3,151,681 | A | 10/1964 | Chudleigh | |
| 3,355,142 | A | 11/1967 | Kammerer et al. | |
| 3,395,758 | A | 8/1968 | Kelly et al. | |
| 3,414,060 | A | 12/1968 | Zak | |
| 3,773,441 | A | 11/1973 | Schertz | |
| 4,134,454 | A * | 1/1979 | Taylor | 166/320 |
| 4,270,610 | A * | 6/1981 | Barrington | 166/317 |
| 4,532,987 | A | 8/1985 | Reed | |
| 4,633,952 | A * | 1/1987 | Ringgenberg | 166/336 |
| 4,971,099 | A | 11/1990 | Cyvas | |
| 5,156,220 | A | 10/1992 | Forehand et al. | |

(Continued)

FOREIGN PATENT DOCUMENTS

| | | |
|---|---|---|
| EP | 893575 | 1/1999 |
| WO | WO0075484 | 12/2000 |

(Continued)

OTHER PUBLICATIONS

Petrowell, "Advanced Reservoir Control (ARC) Hydraulic Sleeve," obtained from http://www.petrowell.co.uk/, undated.

(Continued)

*Primary Examiner* — Giovanna Wright
*Assistant Examiner* — Kipp Wallace
(74) *Attorney, Agent, or Firm* — Wong, Cabello, Lutsch, Rutherford & Brucculeri LLP

(57) ABSTRACT

A downhole flow device has a sliding and ported sleeves. A seal has a first component on the sliding sleeve and a second component on the ported sleeve. These components engage one another to seal flow through the ports in the ported sleeve. The components move apart to allow fluid flow through the ports. The components are protected from abrasion and flow by virtue of the seal's structure and how it is opened. The sliding sleeve moves hydraulically along an axis of the ported sleeve to reveal successive ports defined along the sleeve's axis. Operation of the device and the seal address both erosion and damage from differential pressure problems. Thus, the seal prevent damage when unloading a differential pressure across it, and abrasive flow does not have the opportunity to impinge on the sealing surfaces to cause erosion.

34 Claims, 8 Drawing Sheets

(56) References Cited

U.S. PATENT DOCUMENTS

| | | | |
|---|---|---|---|
| 5,263,683 | A | 11/1993 | Wong |
| 5,299,640 | A | 4/1994 | Streich et al. |
| 5,309,993 | A | 5/1994 | Coon et al. |
| 5,316,084 | A | 5/1994 | Murray et al. |
| 5,364,110 | A | 11/1994 | Streich et al. |
| 5,443,129 | A | 8/1995 | Bailey et al. |
| 5,611,547 | A | 3/1997 | Baugh et al. |
| 5,718,289 | A | 2/1998 | Schnatzmeyer |
| 5,896,928 | A | 4/1999 | Coon |
| 5,906,238 | A | 5/1999 | Carmody et al. |
| 5,957,207 | A | 9/1999 | Schnatzmeyer |
| 5,957,208 | A | 9/1999 | Schnatzmeyer |
| 5,979,558 | A | 11/1999 | Bouldin et al. |
| 6,041,857 | A | 3/2000 | Carmody et al. |
| 6,044,908 | A | 4/2000 | Wyatt |
| 6,070,670 | A | 6/2000 | Carter et al. |
| 6,082,458 | A | 7/2000 | Schnatzmeyer |
| 6,112,816 | A | 9/2000 | Orzechowski et al. |
| 6,189,619 | B1 | 2/2001 | Wyatt et al. |
| 6,253,850 | B1 | 7/2001 | Nazzai et al. |
| 6,260,616 | B1 | 7/2001 | Carmody et al. |
| 6,276,458 | B1 | 8/2001 | Malone et al. |
| 6,293,344 | B1 | 9/2001 | Nixon et al. |
| 6,308,783 | B2 | 10/2001 | Pringle et al. |
| 6,318,729 | B1 | 11/2001 | Pitts, Jr. et al. |
| 6,328,112 | B1 | 12/2001 | Malone |
| 6,328,729 | B1 | 12/2001 | Jervis |
| 6,334,486 | B1 | 1/2002 | Carmody et al. |
| 6,338,385 | B1 | 1/2002 | Muchow |
| 6,371,208 | B1 | 4/2002 | Norman et al. |
| 6,422,317 | B1 | 7/2002 | Williamson, Jr. |
| 6,434,651 | B1 | 8/2002 | Gentry, Jr. |
| 6,446,729 | B1 | 9/2002 | Bixeman et al. |
| 6,450,225 | B2 | 9/2002 | Yukawa et al. |
| 6,484,800 | B2 | 11/2002 | Carmody et al. |
| 6,494,265 | B2 | 12/2002 | Wilson et al. |
| 6,513,599 | B1 | 2/2003 | Bixenman et al. |
| 6,516,888 | B1 | 2/2003 | Gunnarson et al. |
| 6,575,243 | B2 | 6/2003 | Pabst |
| 6,612,547 | B2 | 9/2003 | Carmody et al. |
| 6,668,935 | B1 | 12/2003 | McLoughlin et al. |
| 6,715,557 | B2 | 4/2004 | Wetzel et al. |
| 6,715,558 | B2 | 4/2004 | Williamson |
| 6,722,439 | B2 | 4/2004 | Garay et al. |
| 6,860,330 | B2 | 3/2005 | Jackson |
| 6,869,063 | B2 | 3/2005 | Gunnarson et al. |
| 6,880,638 | B2 | 4/2005 | Haughom et al. |
| 6,966,380 | B2 | 11/2005 | McLoughlin et al. |
| 6,973,974 | B2 | 12/2005 | McLoughlin et al. |
| 7,258,323 | B2 | 8/2007 | Dwivedi |
| 7,363,981 | B2 | 4/2008 | Coon et al. |
| 7,377,327 | B2 | 5/2008 | Jackson |
| 7,823,633 | B2 * | 11/2010 | Hartwell ..... 166/66.6 |
| 2003/0056951 | A1 | 3/2003 | Kaszuba |
| 2003/0159832 | A1 | 8/2003 | Williamson |
| 2004/0041120 | A1 | 3/2004 | Haughom et al. |
| 2004/0108116 | A1 | 6/2004 | McLoughlin et al. |
| 2004/0129431 | A1 | 7/2004 | Jackson |
| 2005/0263279 | A1 | 12/2005 | Vachon |
| 2009/0159290 | A1 | 6/2009 | Lauderdale |
| 2009/0277642 | A1 | 11/2009 | Curington |

FOREIGN PATENT DOCUMENTS

| | | |
|---|---|---|
| WO | WO0079094 | 12/2000 |
| WO | WO0121935 | 3/2001 |
| WO | WO0216730 | 2/2002 |
| WO | WO2006120466 | 11/2006 |

OTHER PUBLICATIONS

Omega Completion Technology "Selective Choke Valve," obtained from http://www.omega-completion.com, (c) 2009, REV 002: 26/08/09, 2 pages.

Weatherford, "WXO and WXA Standard Sliding Sleeves," obtained from www.weatherford.com, (c) 2007-2008, 2 pages.

Weatherford, "Advanced Reservoir Controlled (ARC) Sleeve," obtained from www.weatherford.com, (c) 2009, 2 pages.

International Search Report for PCT/GB2006/001750, dated Nov. 15, 2006.

Examiner's First Report in counterpart Australian Appl. No. 2010243081, dated Mar. 2, 2012.

First Office Action in counterpart Canadian Appl. No. 2721545, dated Jan. 3, 2013.

* cited by examiner

DOWNHOLE FLOW DEVICE WITH EROSION RESISTANT AND PRESSURE ASSISTED METAL SEAL

BACKGROUND

The problem of erosive damage to seals and metal components in downhole flow devices has been a challenge in the industry for quite some time. In a wellbore, for example, sliding sleeves are used in applications where high velocity flow can create a very hostile environment. The high velocity flow, especially when it contains solids, can induce flow erosion even in the hardest materials available. Additionally, when a pressure differential is unloaded across a conventional seal, severe damage can occur that renders the seal inoperable.

In the prior art, techniques that address unloading of a pressure differential across seals have used thin equalizing slots and diffuser type seals. The arrangement is intended to prevent damage to two sets of seals, or packing units, that create a barrier between the annulus and tubing pressure. Examples of this prior art technique are disclosed in U.S. Pat. Nos. 5,316,084 and 5,156,220. Prior designs such as these may not prevent damage to seals caused by abrasive flow because the seals may never be adequately protected from an initial surge of pressure during the opening sequence.

Although prior art sealing techniques may be effective, operators are continually striving for improvements to reduce the effects of erosion or pressure differential on seals used downhole. Accordingly, the subject matter of the present disclosure is directed to overcoming, or at least reducing the effects of, one or more of the problems set forth above.

SUMMARY

A downhole flow device has a sliding sleeve and a ported sleeve. The sliding sleeve moves hydraulically along an axis of the ported sleeve to reveal successive ports defined along the axis of the ported sleeve. Fluid pressure applied to an open control line enters a sealed chamber between the sliding sleeve and the housing and moves the sliding sleeve along the ported sleeve.

To limit movement of the sliding sleeve, a catch has a dog that engages in a slot in the sliding sleeve. As the sliding sleeve moves, the dog moves the catch with the sliding sleeve. At a pinnacle position of the catch, the sliding sleeve can no longer be moved by the hydraulic fluid due to the catch engaging a stop. When moving the catch to its stop, the sliding sleeve reveals one of the ports in the ported sleeve, allowing flow to pass through the device.

To reset the catch so the sliding sleeve can be advanced to reveal the next port, a trigger between the sliding sleeve and housing can also move by the hydraulic pressure applied. This trigger moves on the sliding sleeve until it reaches another stop that limits its movement. When hydraulic pressure is released, the trigger moves by the bias of a spring to a reset position on the sliding sleeve. As it moves, the trigger dislodges the catch's dog from the sleeve's slot. This allows a spring to move the catch to a next lower position where the dog can then engage in a next slot on the sliding sleeve. Once completed, the mechanism is reset so that reapplication of hydraulic pressure can move the sliding sleeve to its next position. Applying hydraulic pressure to another port can move the sliding sleeve all the way back to its closed condition.

A seal is provided between the sliding sleeve and the ported sleeve. The seal has a first seal component disposed on the sliding sleeve and has a second seal component disposed on the ported sleeve. These seal components engage one another to seal flow, and they move apart to allow fluid flow through the ports in the ported sleeve. Operation of the device and the seal reduce both erosion and damage caused by high velocity flow, abrasive flow, and differential pressures. In other words, the device and seal prevent damage to the seal when unloading a differential pressure across it, and the seal is designed in such a way that abrasive flow does not have the opportunity to impinge on the sealing surface to cause erosion.

The foregoing summary is not intended to summarize each potential embodiment or every aspect of the present disclosure.

DETAILED DESCRIPTION

A. Downhole Flow Device

Figure 1A:
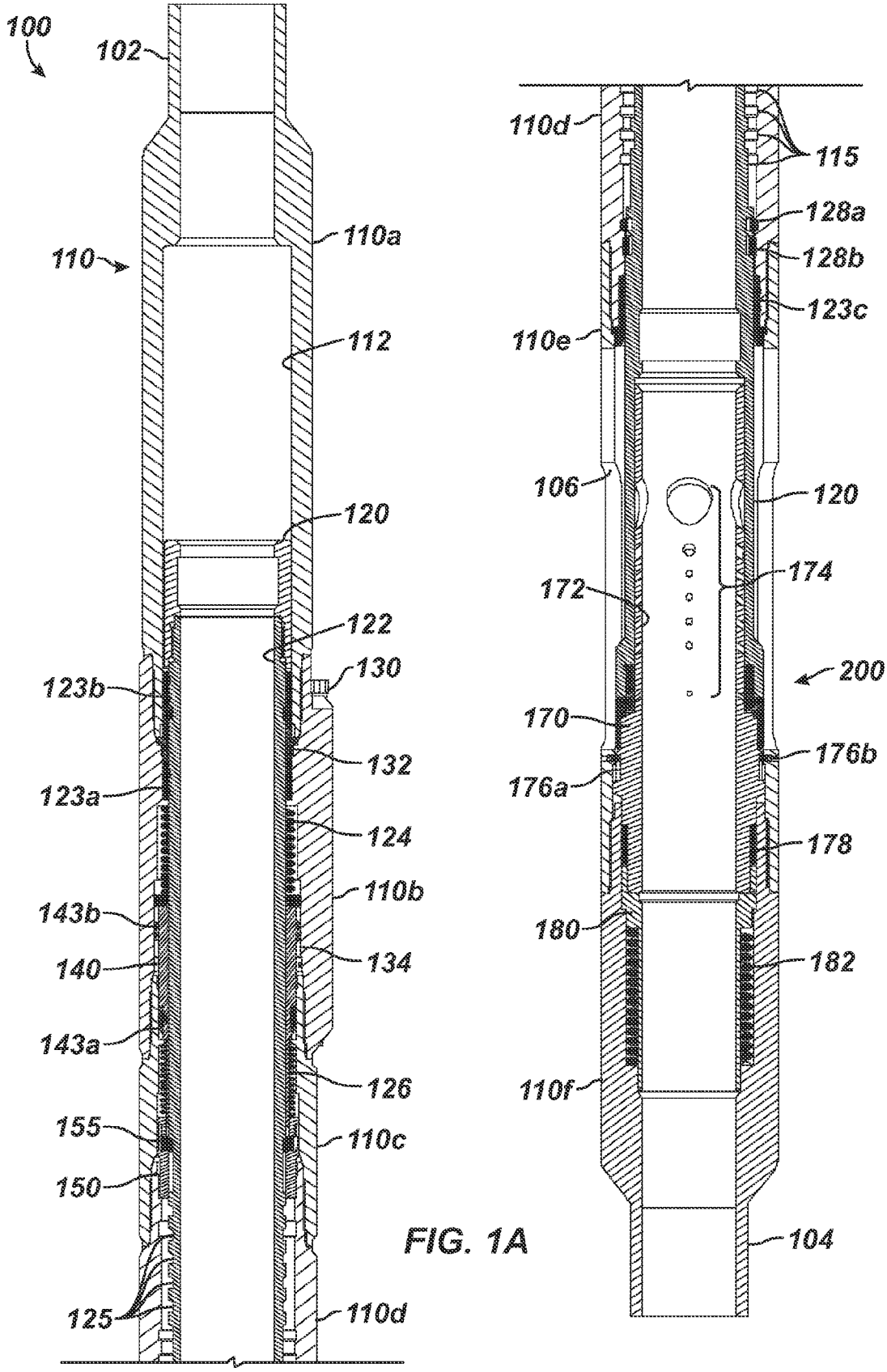
FIG. 1A illustrates a cross-sectional view of a downhole tool according to the present disclosure.
Figure 1B:
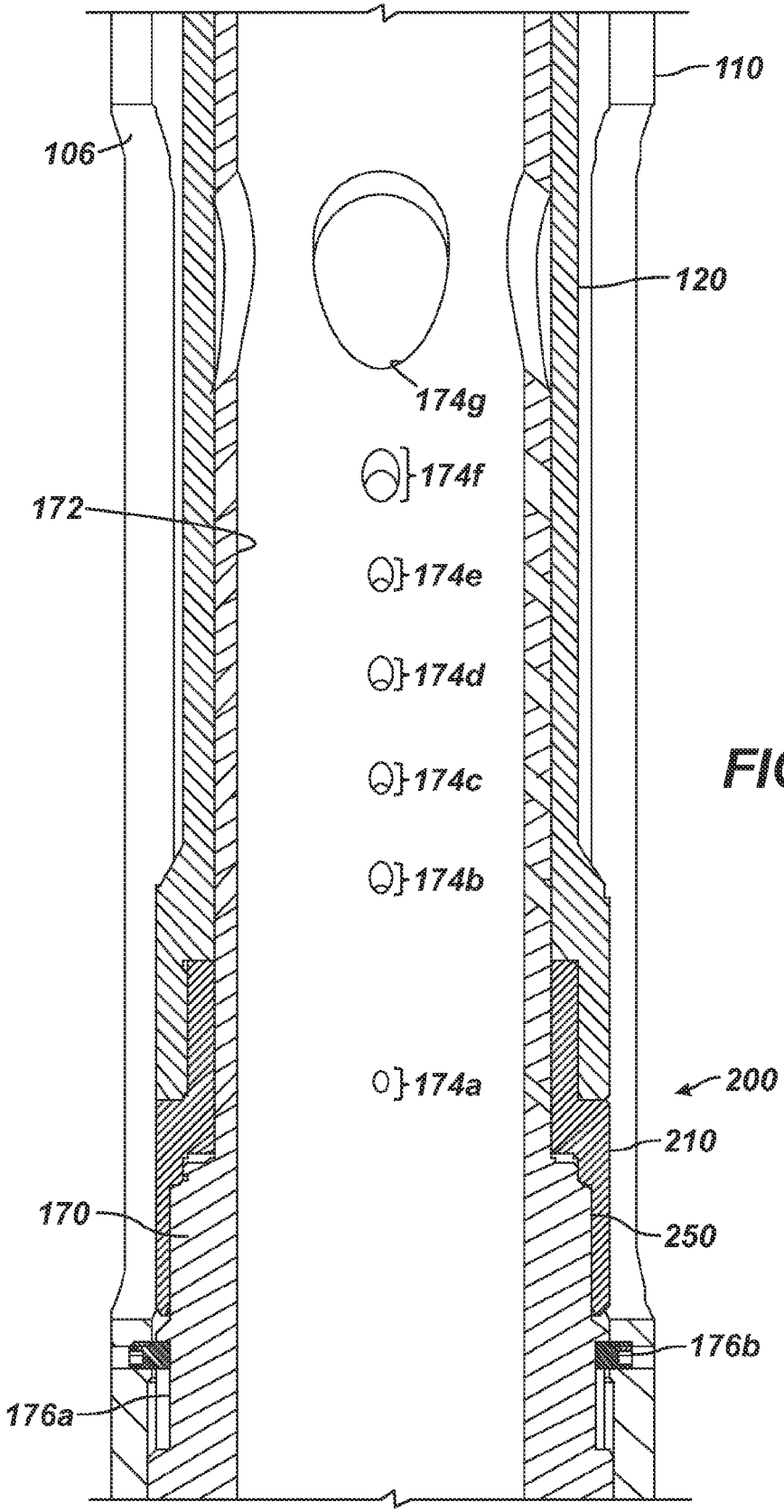
FIG. 1B illustrates a detailed view of a portion of the downhole tool.

In FIGS. 1A-1B, a downhole flow device 100 has a housing 110, a sliding sleeve 120, a ported sleeve 170, a landing 180, and a seal 200. As shown, the housing (indicated generally by 110) can have a number of interconnecting housing portions 110*a-f* that facilitate assembly. In the present implementation, the flow device 100 is a reservoir control tool that couples at uphole and downhole ends 102/104 to other tubing components (not shown), although the teachings of the present disclosure may be used on any other downhole flow device, such as a sliding sleeve, a downhole control valve, a crossover tool, etc. When used for reservoir control, the tool 100 operates as a hydraulically-actuated variable choke valve and can adjust the rate of production or injection of fluid through the tool 100.

For example, the tool 100 can be run as part of a completion tubing string in the well. Once deployed, operators can operate the tool 100 to variably choke back the production from the well's annulus into the tool 100. This may be done to reduce the rate of water produced from the well or to balance the rate of production (and the rate of pressure drop) of one producing zone against another. In some cases, each production zone could have a corresponding tool 100 that can be varied. As opposed to production, the tool 100 may also be used for varied injection of fluids from the tubing string into the annulus of the well.

The ported sleeve 170 has a plurality of ports 174*a-g* disposed on an axis of the sleeve 170. Exposure of more or less of the ports 174*a-g* increases or decreases the flow through the tool 100. Although shown having several separate ports 174*a-g*, the ported sleeve 170 can have one or more ports disposed along the axis of the sleeve 174 so that more or less exposure of the one or more ports can increase or decrease flow through the tool 100. For example, the ported sleeve 170 can having one port that increases in size along the axis of the ported sleeve 170 and can have any desirable shape.

To choke the flow into or out of the tool 100 completely, the sliding sleeve 120 fits all the way onto the ported sleeve 170 as shown in FIGS. 1A-1 B so that none of the ports 174*a-g* in the ported sleeve 170 are exposed. As shown, the seal 200 on the closed sleeves 120/170 seals flow into (or out of) the tool 100 when the sliding sleeve 120 is in a closed position on the ported sleeve 170. To achieve variable choking, the tool's sliding sleeve 120 can be hydraulically moved relative to the ported sleeve 170, and the changing position of the sliding sleeve 120 controls the flow into (or out of) the sleeve's bore 172 by disengaging the seal 200 and exposing more or less ports 174 in the ported sleeve 170.

When the sliding sleeve 120 is moved, for example, the seal 200 separates, and the sliding sleeve 120 opens relative to the ports 174 to allow fluid to flow from a surrounding annulus through windows 106 in the tool's housing 110 (i.e., portion 110*e*) and into the ported sleeve's bore 172 (or vice versa). As best shown in FIG. 1B, the ports 174*a-g* defined in the ported sleeve 170 generally increase in size (diameter) along the axis of the sleeve 170. Therefore, the first ports 174*a* (four of which are defined around the circumference of the ported sleeve 170) have a first diameter, while the other ports 174*b-e* above them have a slightly greater diameter. The next highest port 174*f* has an even greater diameter, and the last port 174*g* has the largest diameter. In this way, as the sliding sleeve 120 moves along the ported sleeve 170, the sliding sleeve 120 successively reveals more of the ports 174*a-g*, which increases the flow through the tool 100.

In the current arrangement, the tool 100 can operate at eight discrete positions to control the amount of flow area through the tool 100. These positions are defined in percentages of the flow area of the tubing string (specifically the diameter of the ported sleeve's bore 172). For example, the tool's positions can be defined as follows: 0% closed, 1% open, 3% open, 5% open, 7% open, 9% open, 15% open, and 100% open. Therefore, with the tool 100 set at the 5% position, the ports 174*a-c* are exposed, and the flow area through the tool 100 is 5% of the flow area through comparably sized tubing. As will be appreciated, these values are illustrative. The actual size and number of ports 174*a-g* for an implementation depends on the overall size of the tool 100 and the desired or expected flow characteristics as well as other implementation specific details. In other examples, the tool 100 may have more or less ports, and some or all of the ports may have the same diameters.

B. Seal for Downhole Flow Device

As best shown in FIG. 1B, the seal 200 has first and second seal components 210/250 that mate with one another when the sliding sleeve 120 is closed. The first (moving) component 210 moves with the sliding sleeve 210, while the second (stationary) component 250 remains stationary. Either one or both of these components 210/250 can be incorporated into its respective sleeve (as is the stationary component 250) or can be an independent component affixed onto its respective sleeve (as is the movable component 210). As discussed below, the seal components 210/250 are intended to reduce damage to the seal 200, and the design of the seal 200 is such that it resists erosion and is self-protecting.

Figure 2:
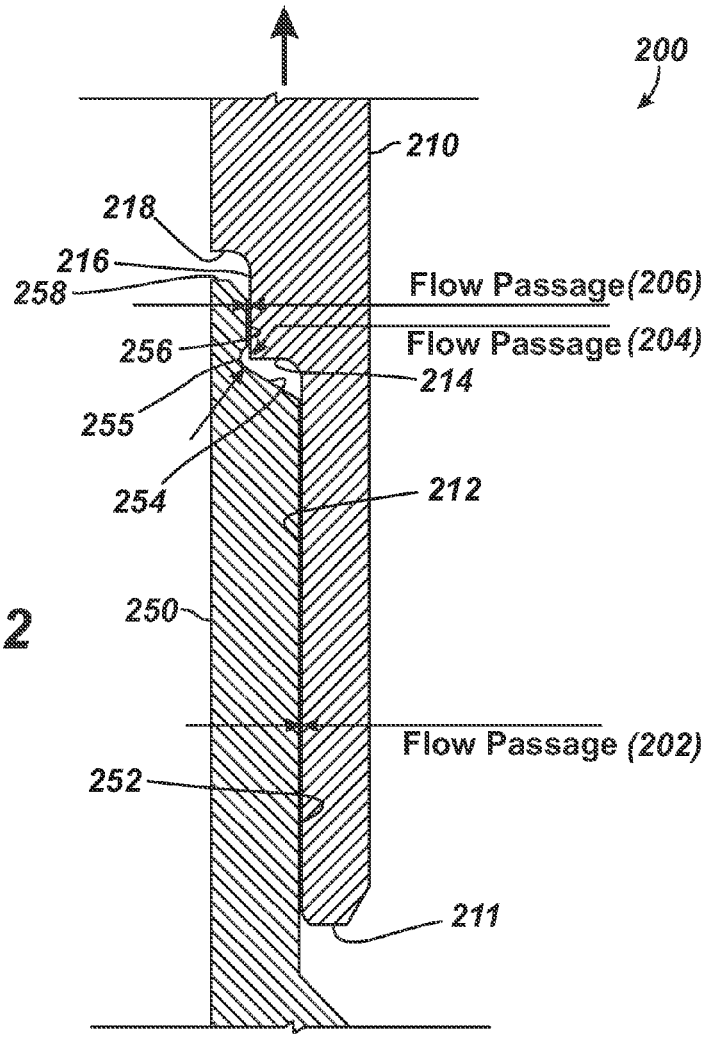
FIG. 2 illustrates a seal of the disclosed tool in more detail.

Details of the seal 200 are shown in FIG. 2. The moving component 210 has a first inner shelf 212, a first inner ledge 214, a second inner shelf 216, and a second inner ledge 218—each of which face inward toward the ported sleeve (not shown). The stationary component 250 has a somewhat complimentary configuration, including a first outer shelf 252, a first outer ledge 254, a second outer shelf 256, and a second outer ledge 258—each of which face outward from the ported sleeve (not shown). The stationary component 250 may also define a well 255 where the second outer shelf 256 mates with the first outer ledge 254.

The shelves 212/252 define a first flow passage 202, the first ledges 214/254 define a second flow passage 204, and the second shelves 216/256 define a third flow passage 206 through which fluid can flow through the seal 200. The flow passages 202, 204, and 206 create seal points between the metal-to-metal seal produced between the components 210/250. Engagement between the first ledges 214/254 produces the primary sealing function when the components 210/250 are closed against one another.

With an understanding of the seal 200 and its components 210/250, discussion now turns to how the seal 200 achieves pressure assisted and erosion resistant sealing on the tool 100.

1. Pressure Assisted Sealing

Figure 4A:
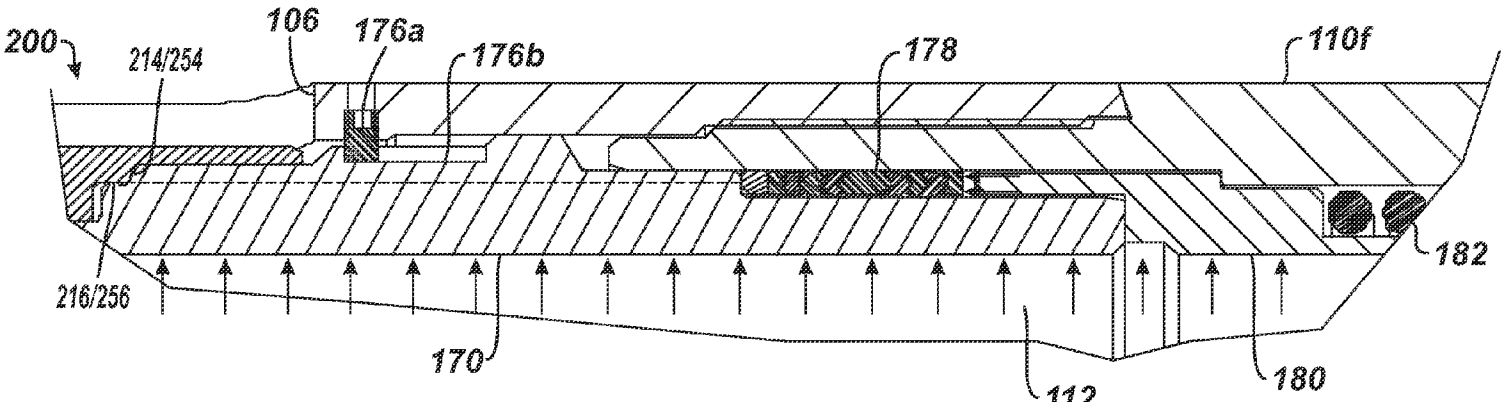
FIGS. 4A-4B show pressure assistance of the seal for the downhole tool when exposed to internal or external pressure differentials.
Figure 4B:
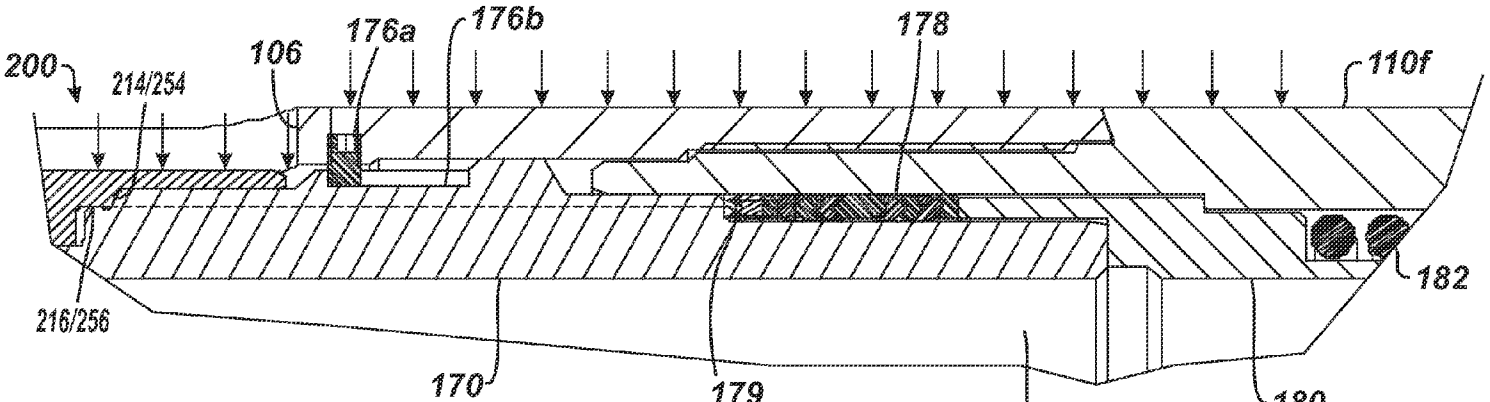
Figure 5:
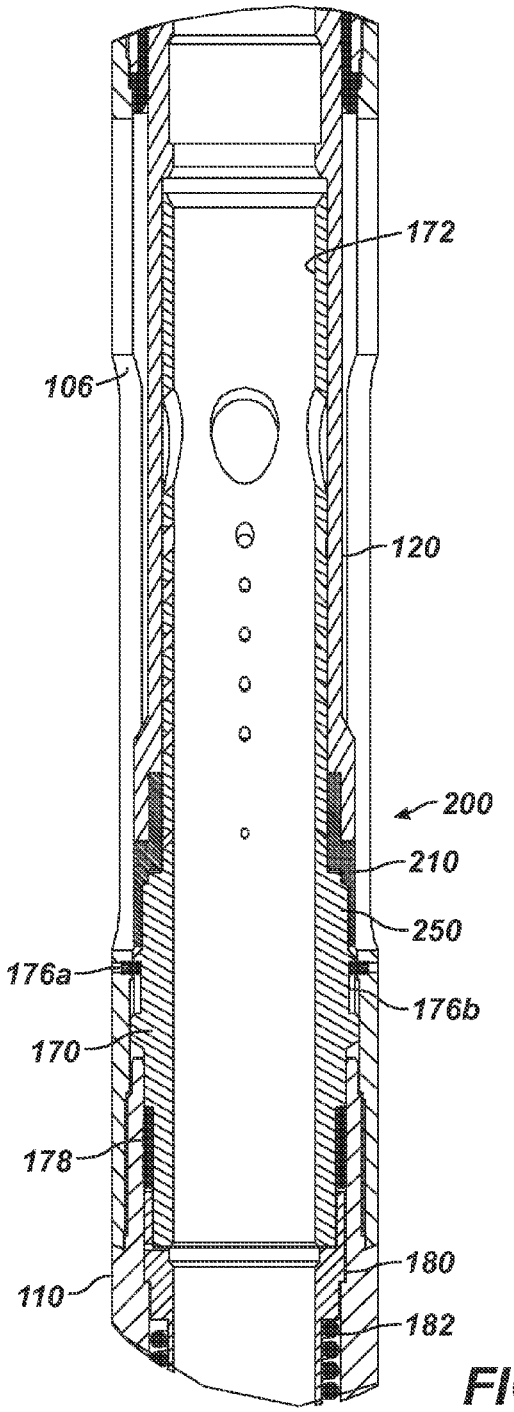
FIG. 5 shows the downhole tool in a closed condition.

The seal 200 is assisted closed in metal-to-metal engagement by either internal pressure acting inside the tool 100 or by external pressure acting outside the tool 100. In FIGS. 4A-4B, the tool 100 is shown closed, and the seal components 210/250 are shown mated with one another. A lower packing element or seal 178 seals between the ported sleeve 170 and the housing 110 (i.e., portion 110*f*) and isolates fluid pressure inside the tool 100 from outside the tool 100.

As noted previously, the primary sealing function of the closed seal 200 is provided by engagement of ledges 214/254. As constructed, the engagement 214/254 are set at a circumference that matches a centerline circumference of the lower packing seal 178 on the tool 100. As described below, the arrangement of the ledges 214/254, centerline, the packing seal 178, and other features give pressure assistance to the seal 200 regardless of whether the tool 100 is exposed to internal or external pressure differentials.

In FIG. 4A, an internal pressure differential in the bore 112 is shown acting on the tool 100. Fluid pressure is capable of acting against the distal end of the ported sleeve 120, which is exposed and unsealed relative to the fluid pressure in the bore 112. As a consequence, the fluid pressure can act against the lower shoulder of the packing seal 178. This fluid pressure creates a piston effect on the ported sleeve 170. The resulting pressure pushes the ported sleeve 170 and its seal component 250 toward the sliding sleeve 120 and its seal component 210, thereby assisting the sealing engagement between them.

In FIG. 4B, an external pressure differential is shown acting on the tool 100, but the seal 200 is also pressure assisted in this circumstance. The external fluid pressure acts against the upper shoulder of the packing seal 178. This moves the packing seal 178 away from the ported sleeve's adjacent shoulder so that the seal 178 abuts a landing 180 unconnected to the ported sleeve 170. As a consequence, the fluid pressure can act against the ported sleeve's shoulder. Again, this tends to create a piston effect on the ported sleeve 170 that attempts to push the ported sleeve 170 and its seal component 250 toward the sliding sleeve 120 and its seal component 210. Therefore, the seal 200 and configuration of the ledges 214/254 and seal 178 help pressure assist the seal produced regardless of whether exposed to an internal or external pressure differential.

2. Erosion Resistant Sealing

As noted previously, the tool 100 can encounter problems caused by erosive damage to seals and metal components when varying flow therethrough. The seal 200 of the present disclosure is intended to control the velocities of abrasive flow and isolates portion of the seal 200 from the flow as much as possible to mitigate erosive damage.

Returning to FIG. 2, the first flow passage 202 from the shelves 212/252 creates a very small choke when the components 210/250 are closed or slightly open. The second shelves 216/256 providing the second flow passage 206 also provide a secondary choke that reduces the flow possible through the seal components 210/250.

At the instant the seal components 210/250 start to separate and break the seal between the ledges 214/254, the first flow passage 202 allows fluid to flow through the seal 200, but the small gap between the shelves 212/252 defines the smallest available flow area through the seal 200. This secondary choke from the sealing ledges 214/254 also limits the detrimental flow when the seal components 210/250 are first separated.

The limited flow area through the first flow passage 202 means that any sudden erosive flow from fluids flowing from the annulus into the tool (or vice versa) mainly interacts with the shelves 212/252. Accordingly, the shelves 212/252 take the brunt of the erosive flow rather than the sealing ledges 214/254 themselves, which are susceptible to detrimental erosion. In this way, the seal 200 can be self-protecting by making erosion occur away from the sealing ledges 214/254 at initial opening of the seal 200.

Figure 3:
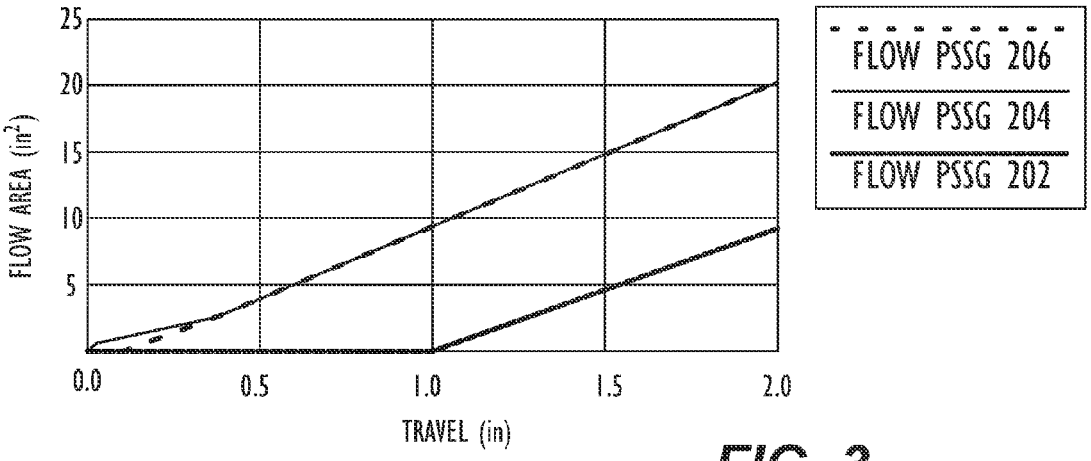
FIG. 3 illustrates a graph of flow passages for the seal of FIG. 2.

As the sliding sleeve 120 is moved on the ported sleeve 170, the area of the flow through passages 202, 204, 206 changes. Details of how the flow area changes are shown in FIG. 3, which graphs some calculations for a tool 100 having an internal diameter of about 5-in. As evident from FIG. 3, the first flow passage 202 defines a limiting flow area through the tool 100 as the seal 200 is initially opened (i.e., when the sleeve 120 has traveled from 0 to 1-in.).

In one implementation, the sliding sleeve (120) travels approximately 0.5-in. open from the ported sleeve (170) to expose the first port (174*a*) and allow 1% of flow through the tool 100. In this way, the shelves 212/252 act to choke the flow and take the brunt of any erosive flow until the valve is 1% open. Even after that point, the first inner ledge 214 is already moved clear of the first port (174*a*) so the ledge 214 can avoid erosive flow, as detailed below.

FIGS. 5-9 show some initial conditions of the seal 200 as the tool 100 opens (or closes in the reverse). In the closed condition shown in FIG. 5, the flow area is zero, and the sliding sleeve 120 has not moved. Although the flow passages 202, 206 (shown in FIG. 2) may allow for some amount of flow, the second flow passage 204 closes off the seal 200 when the ledges 214/254 are engaged.

Figure 6:
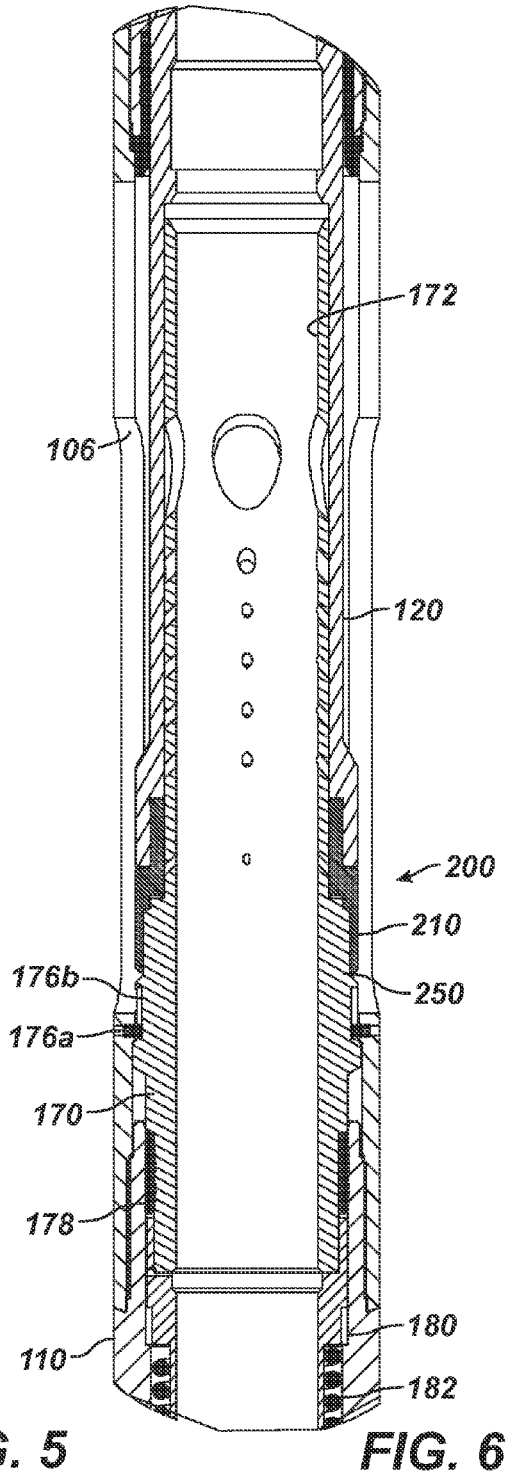
FIG. 6 shows the downhole tool in a first condition towards opening.

In a first open condition shown in FIG. 6, the sliding sleeve 120 is moved upward. The ported sleeve 170 also moved upward because the landing 180 moves by the bias of the spring 182 and pushes the ported sleeve 170 upward. This keeps the seal 200 closed. Eventually, the pins 176*a* in the sleeve's slots 176*b* limit the travel of the sleeve 170 and landing 180.

Figure 7:
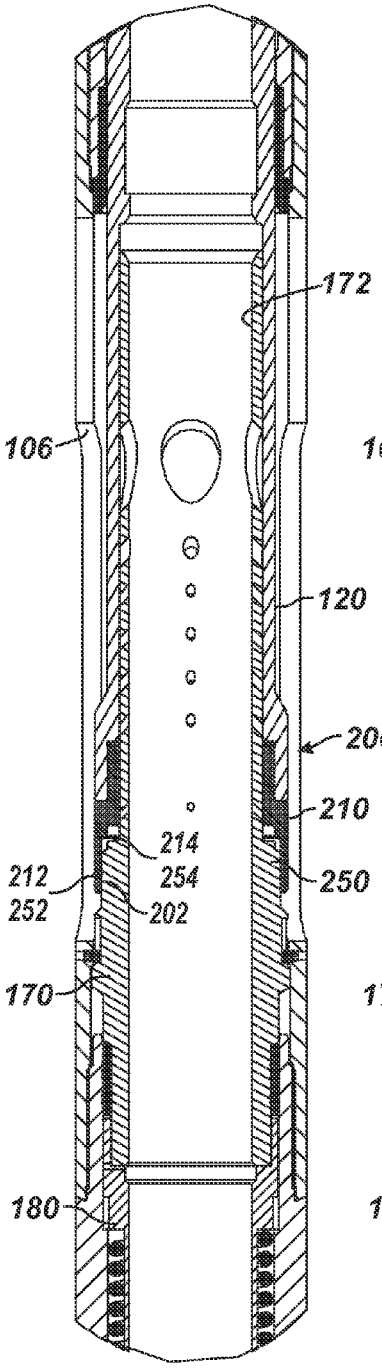
FIGS. 7-9 show the downhole tool in several subsequent conditions towards opening.

As the sliding sleeve 120 continues to open, it reaches a first equalizing condition shown in FIG. 7 when the sleeve 120 travels from 0.00-in. to about 0.125-in. The ledges 214/254 move apart. The length and diametric gap of the ledges 214/254 provides for an orifice effect of any flow through the seal 200. This helps to protect the metal seal surfaces during initial unloading of pressure and flow as described previously. The timing of this orifice effect is minimal as it is needed only during the first movement of separation of the two seal components 210/250. However, the flow passage 202 (See also, FIG. 2) from the shelves 212/252 act to choke the flow, thereby limiting the actual flow that travels through the seal 200.

The first flow passage 202 from the first shelves 212/252 is extended in comparison to the others so that these shelves 212/252 can define a sacrificial component during initial unloading of pressure. As the two sealing components 210/250 continue to separate, the external extension from the first flow passage 202 maintains a tight clearance and creates an orifice effect of any flow therethrough. As the sealing shelves 212/252 move further apart, the volume and area increases between the two seal components 210/250, thus causing a low pressure area and a drop in flow to develop.

Figure 8:
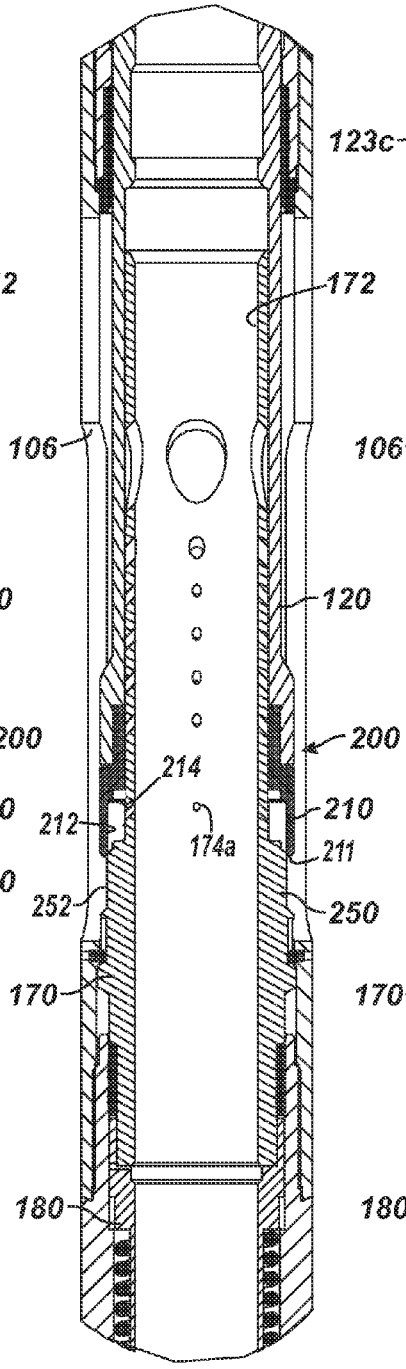

The choke effect from the shelves 212/252 continues until the moving component 210 has moved until its distal ledge 211 reaches the end of the first outer shelf 252 as shown in FIG. 8. Beyond this position, the seal 200 reaches a second equalizing condition when the distal ledge 211 comes to separate from the ledge 254. When this occurs, the first inner ledge 214 has preferably already passed free of the first ports 174*a* in the ported sleeve 170. Therefore, erosive damage to the ledge 214 used for closed sealing can be reduced. The shelves 212/252 and the distal ledge 211, although they may be subject to more of the erosive flow, are more suited places for such damage to occur. Once the two sealing shelves 212/252 slide far enough apart, the movable component 210 becomes disengaged, allowing full flow into the flow port 172*a*.

At a subsequent opened conditions after FIG. 8, the flow through the seal 200 increases as flow ports 174*a* are further revealed. Finally, at the opened condition shown in FIG. 9 when the sliding sleeve 120 has traveled to about 2.00-in., the flow area through the ports 174*a* is 1% of the flow possible through the diameter of the ported sleeve 170.

With further movement of the sliding sleeve 120, more of the ports 174 in the ported sleeve 170 can be revealed. Again, as note previously, the tool has eight discrete positions in which the sliding sleeve 120 can reveal ports 174 on the ported sleeve 170 to control flow between 0%, 1%, 3%, 5%, 7%, 9%, 15%, and 100%. Details on how the sliding sleeve 120 is moved relative to the ported sleeve 170 are discussed below.

C. Hydraulic Activation

As noted previously, the sliding sleeve 120 is moved relative to the ported sleeve 170. In general, the sliding sleeve 120 can be moved by any of the techniques conventionally used in the art for a flow device. For example, the sliding sleeve 120 can be moved manually using an appropriate pulling tool, hydraulically by a piston arrangement, or other suitable mechanism. In the current implementation, the disclose tool 100 uses a hydraulically actuated ratcheting motion to move the sliding sleeve 120 relative to the ported sleeve 170. Details of how the tool 100 operates hydraulically are provided in FIGS. 10-14.

Figure 10:
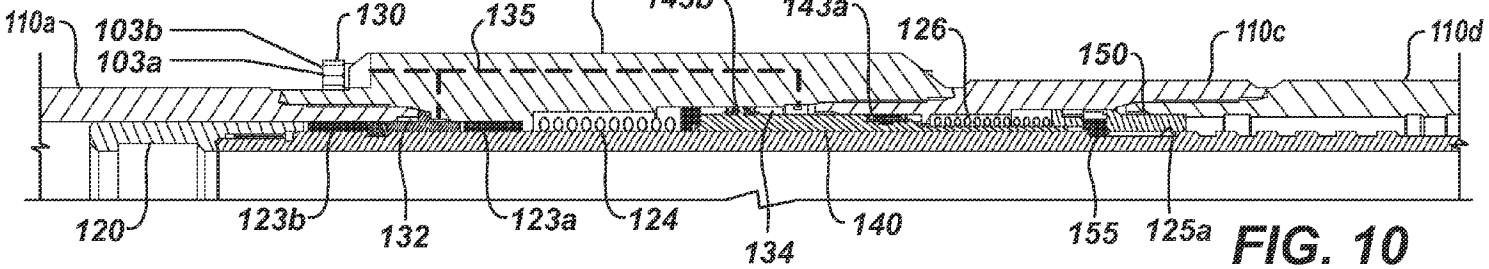
FIGS. 10-14 show the downhole tool being hydraulically actuated in various stages of opening.

In FIG. 10, portion of the tool 100 is shown in its closed condition so that the sliding sleeve 120 engages the ported sleeve (not shown) with the sealing arrangement as discussed previously. As shown in FIG. 10, two control lines 103*a-b* connect to hydraulic connections 130 (only one shown) on the tool 100. Control fluid in the control lines 103*a-b* hydraulically move the sliding sleeve 120 relative to the ported sleeve (170). These control lines 103*a-b* run from surface equipment down the tubing string to the tool 100. When operators apply pressure to an open control line 103*a*, the tool's sliding sleeve 120 moves from its current position to a next open position (in the order listed previously). When operators apply pressure to a close control line 103*a*, the tool's sliding sleeve 120 moves back completely to its closed position.

In the opening procedure, for example, pressure from the open control line 130*a* enters an open port 135 in the housing 110 (i.e., portion 110*b*) and travels to an outlet at a first chamber 132 between the sliding sleeve 120 and the housing portion 110*b*. The first chamber 132 is formed by upper and lower seals 123*a-b* between the sliding sleeve 120 and housing portions 110*a-b*. Fluid pressure fills this first chamber 132 and acts against a shoulder at upper seal 123*b* to force the sliding sleeve 120 upward in the housing 110 (i.e., the sleeve 120 moves to the left in FIG. 10).

At the same time, fluid pressure from the open port 135 fills a second chamber 134 at another of the port's outlets. Fluid pressure fills this second chamber 134 and acts against a trigger or unlocking sleeve 140 disposed on the sliding sleeve 120. This unlocking sleeve 140 having a shape of a sleeve seals against the housing portions 110*b-c* with upper and lower seals 143*a-b*. The fluid pressure moves the unlocking sleeve 140 upward in the housing 110 along the sliding sleeve 120 (i.e., to the left in FIG. 10). When moved, the unlocking sleeve 140 acts against the bias of a spring 124.

Figure 11:
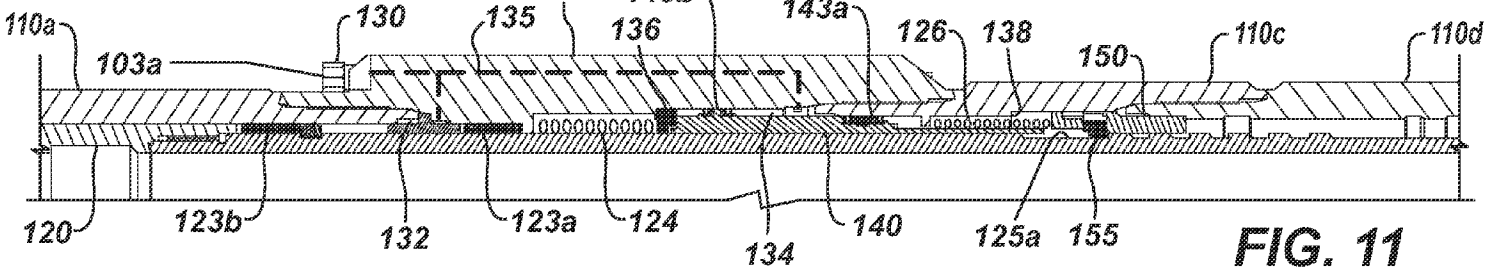

The results of this movement are shown in FIG. 11. As the open control line 130*a* supplies fluid pressure to the chambers 132 and 134, the sliding sleeve 120 moves a first extent inside the housing 110, and the unlocking sleeve 140 also moves along with the sliding sleeve 120 against the bias of the spring 124.

A catch 150 having dogs 155 is also disposed on the sleeve 120. This catch 150 has the shape of a sleeve and has windows for the dogs 155. As the fluid pressure moves the sliding sleeve 120, the catch 150 remains in position relative to the housing 110 due to the bias of another spring 126. Eventually, the sliding sleeve 120 moves a certain distance so that the dogs 155 in the catch 150 engage a shoulder of the first slot 125*a* in the sliding sleeve 120, as shown in FIG. 11.

Figure 12:
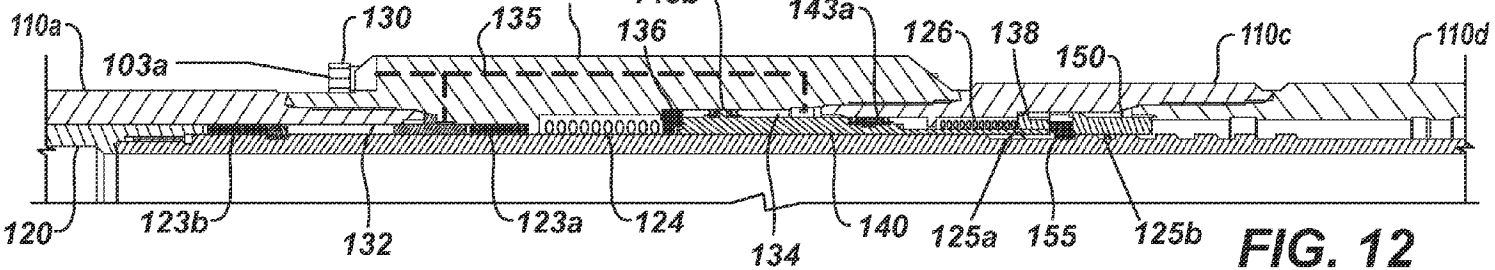

Continued pressure at the open control lines 103*a* moves the sleeve 120 further in the housing 110. The catch 150 engaged by dogs 155 in the first groove 125*a* also moves upward as shown in FIG. 12. Once the catch 150 reaches its topmost stroke, it engages an internal shoulder 138 in the housing portion 110*c*. This prevents further movement upward of the sliding sleeve 120.

Figure 9:
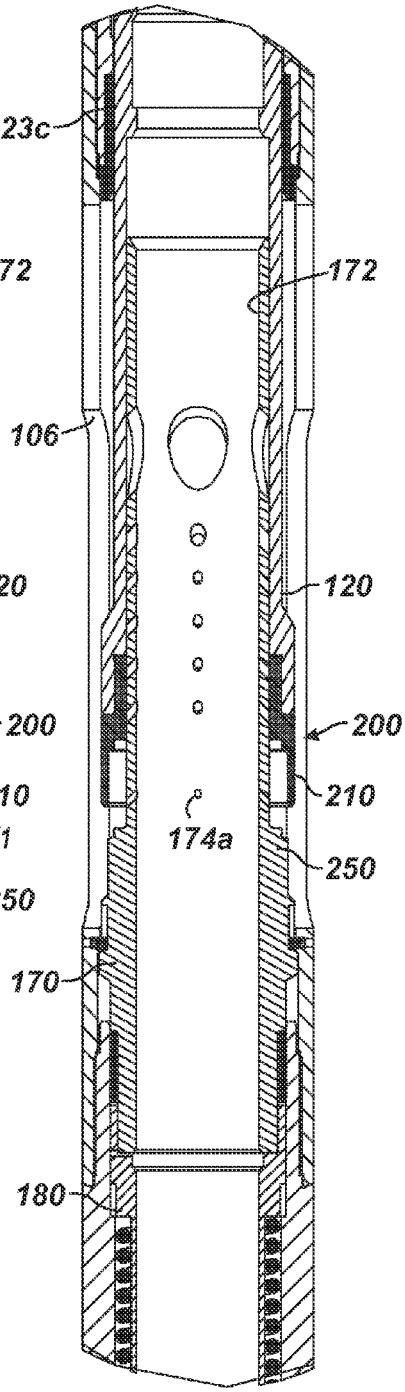
Figure 13:
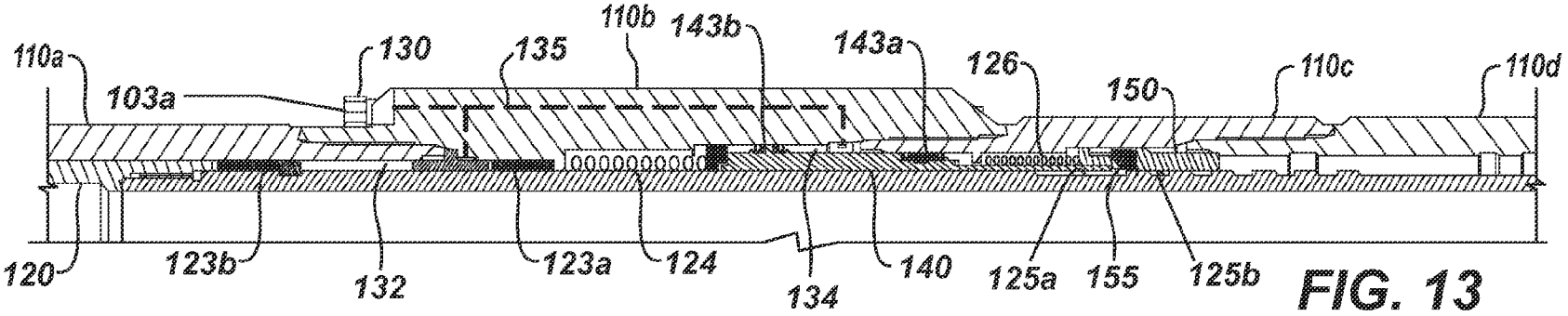

At this point, the sliding sleeve 120 has opened to its first position (i.e., 1% open) to expose the first ports (174*a*) on the ported sleeve (170) (See FIG. 9). To be able to open further, the mechanism is reset. To do this, fluid pressure at the open control line 103*a* is released. The trigger 150 is now freed from upward pressure, and the spring 124 biases the trigger or unlocking sleeve 140 downward (i.e., to the right in FIG. 12). The end of the unlocking sleeve 140 engages the dogs 155, freeing them from the slot 125*a* as shown in FIG. 13.

Although fluid pressure at the open control line 130*a* is released, the sliding sleeve 120 does not move back downward in the housing 110. As noted previously and as shown in FIG. 1A, a pair of C-rings 128*a-b* help to hold the sliding sleeve 120 when positioned at varying stages along the ported sleeve 170. A larger C-ring 128*b* engages a circumferential groove in the housing portion 110*d* to hold the sliding sleeve 120 when in the closed position. The smaller C-ring 128*a* engages in a series of smaller circumferential grooves 115 in the housing portion 110*d* as the sliding sleeve 120 is moved in stages along the ported sleeve 170.

Figure 14:
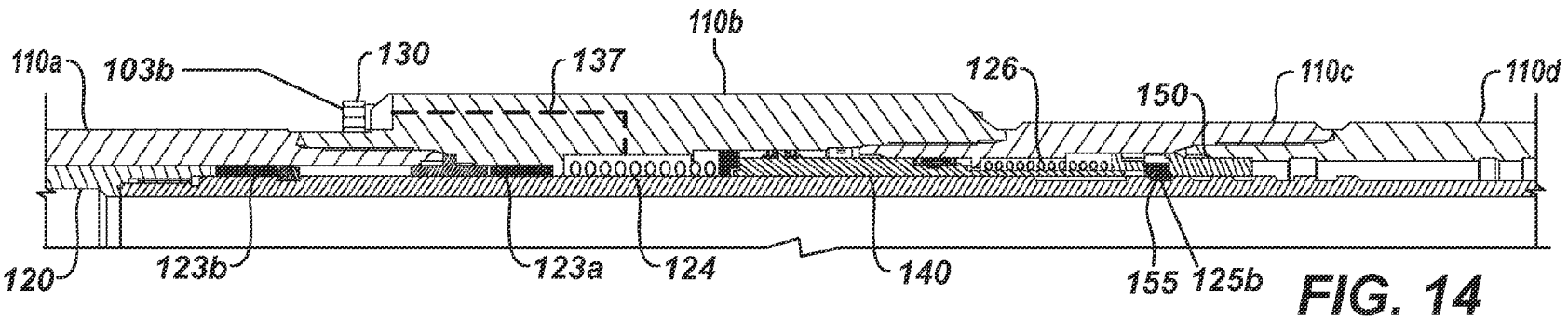

Returning to FIG. 13, the unlocking sleeve 140 engaging the dogs 155 and moved by the spring 124 frees the dogs 155 from the slot 125*a*. This allows the catch 150 to reset. As shown in FIG. 14, the spring 126 pushes the freed catch 150 downward until the dogs 155 engage in the next circumferential slot 125*b* on the sliding sleeve 120.

Further opening of the sliding sleeve 120 can then be achieved through the same process outlined above. Pressure can again be applied to the open control line 103*a*, and the sliding sleeve 120 can be ratcheted upward in the housing to the next slotted position by the repeated actions. Release of pressure at the open control line 103*a* can then reset the hydraulic components for the next movement. Operated in this manner, the tool 100 can be set to any open condition to vary and control the flow from 1% to 100% at the discrete positions in the present example.

In any of the open conditions, the sliding sleeve 120 can be fully closed on the ported sleeve (170) to stop flow. As best shown in FIG. 14, the close control line 103*b* connects by another port 137 to a chamber. In this case, the chamber is formed by upper seal 123*a* between the sliding sleeve 120 and housing portion 110*a* and by lower seal (123*c;* FIGS. 1A & 9) between the sleeve 120 and housing portion 110*d*. When operators apply pressure to the close control line 103*b* at any time, the tool's sleeve 120 moves back to its fully closed position, which isolates the tubing from the annulus and stops flow through the tool 100. In the catch 150, the dogs 155 with their angled edges simply ratchet past the various slots 125 along the sleeve 120 as the sleeve 120 can return to its closed position. Likewise, the C-rings 128*a-b* shown in FIG. 1A also ride along the respective grooves 115 in the housing 110 until the larger C-ring 128*b* engages in the lowest groove when the sleeve 120 has fully closed. The tool 100 can then be opened by applying pressure to the open control line 103*a* according to the previous procedures.

In the current implementation, applying pressure to the close line 103*b* closes the tool 100 all the way no matter what current position the sliding sleeve 120 has. In some implementations, closing at discrete positions may be desired. To do this, an entire reverse assembly of a catch, trigger, dogs, chambers, and slots can be provided on the tool 100 opposite to those already shown. When hydraulic pressure is applied to the close line 103*b*, these reverse components can operate in the same manner described above, but only in the reverse direction. In this way, the sliding sleeve 120 can ratchet closed in discrete positions. To operate, the reverse (downward) components must accommodate the upward movement of the sliding sleeve 120 from the (upward) components (i.e., catch, trigger, dogs, etc. described previously) and vice versa.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole flow device, comprising:

a first sleeve having a first internal bore and one or more ports defined on an axis thereof;

a second sleeve having a second internal bore disposed on the first sleeve, the second sleeve movable along the axis relative to the one or more ports; and a seal disposed between the first and second sleeves and having a first component and a second component, the first component disposed on the first sleeve adjacent a first of the one or more ports and comprising a first outside shelf and a first outside ledge, the first outside shelf extending along the axis and having a distal end and a proximal end, the first outside ledge extending from the distal end of the first outside shelf at a first angle relative to the axis, the second component disposed on the second sleeve and comprising a first inside shelf and a first inside ledge, the first inside shelf extending along the axis parallel to the first outside shelf and having a distal end and a proximal end, the first inside ledge extending from the proximal end of the first inside shelf at a second angle relative to the axis, the first inside and outside ledges engaging toward one another when the seal is moved to a closed condition, the first inside ledge passing the first of the one or more ports along the axis when the distal ends of the first inside and outside shelves meet in a first opened condition relative to one another along the axis, the first inside and outside shelves are disposed at least partially adjacent one another along the axis when the seal is moved between the closed condition and the first opened condition.

2. The device of claim 1, wherein the first sleeve defines a plurality of the one or more ports.

3. The device of claim 2, wherein an increasing number of the ports in the first sleeve exposed by the second sleeve moved along the axis correspond to an increasing percentage of flow area through the first internal bore of the first sleeve.

4. The device of claim 1, wherein the first inside and outside shelves disposed at least partially adjacent one another along the axis define a first minimum flow passage through the seal when the seal is moved between the closed condition and the first opened condition.

5. The device of claim 1, wherein:

the first component comprises a second outside shelf extending along the axis from the first outside ledge;

the second component comprises a second inside shelf extending along the axis from the first inside ledge; and the second inside and outside shelves dispose at least partially adjacent one another and define a second minimum flow passage through the seal when the seal is moved to an intermediate condition between the closed condition and the first opened condition.

6. The device of claim 1, further comprising a packing seal disposed between the first sleeve and a housing.

7. The device of claim 6, wherein the packing seal assists engagement of the second component with the first component in response to an internal pressure deferential acting inside the first internal bore of the first sleeve.

8. The device of claim 6, wherein the packing seal assists engagement of the second seal component with the first seal component in response to an external pressure deferential acting outside the first sleeve.

9. The device of claim 1, further comprising a mechanism moving the second sleeve along the axis of the first sleeve in response to hydraulic pressure.

10. The device of claim 1, wherein the first angle is different from the second angle.

11. The device of claim 5, wherein the first inside and outside shelves are longer along the axis than the second inside and outside shelves.

12. The device of claim 9, wherein the mechanism comprises:

a first piston moving the second sleeve in a first direction in response to first hydraulic pressure, a second piston moving a trigger disposed on the second sleeve in the first direction in response to the first hydraulic pressure, and a catch having a dog engaging in a first slot in the second sleeve and moving in the first direction with the second sleeve.

13. The device of claim 12, wherein in the absence of the first hydraulic pressure, the trigger moves in a second direction opposite to the first direction and disengages the dog from the first slot.

14. The device of claim 13, wherein the catch moves in the second direction until the dog engages in a second slot defined in the second sleeve.

15. The device of claim 12, wherein a first biasing member biases the trigger in the second direction; and wherein a second biasing member biases the catch in the second direction.

16. The device of claim 12, wherein the mechanism moves the second sleeve along the axis of the first sleeve in a second direction opposite the first direction in response to second hydraulic pressure.

17. A downhole flow device, comprising:

a housing having a landing disposed therein;

a first sleeve disposed in the housing and having an end abutting the landing, the first sleeve having a first internal bore and defining one or more ports on an axis thereof;

a first seal component disposed on the first sleeve adjacent the one or more ports;

a packing seal disposed between the first sleeve and the housing;

a second sleeve having a second internal bore disposed on the first sleeve, the second sleeve movable along the axis relative to the one or more ports; and a second seal component disposed on the second sleeve and engageable with the first seal component, wherein the first sleeve defines a first shoulder facing away from the first seal component and facing toward a second shoulder defined on the landing, the first and second shoulders forming an annular space around the first sleeve, wherein the packing seal has first and second ends and is movably disposed in the annular space, the packing seal assisting engagement of the second seal component with the first seal component in response to an internal pressure deferential acting inside the first internal bore of the first sleeve.

18. The device of claim 17, further comprising a biasing member biasing the landing to abut the end of the first sleeve, wherein the first sleeve is movable in the housing.

19. The device of claim 18, wherein the first sleeve defines a slot, and wherein the housing comprises a pin disposed in the slot, the pin limiting movement of the first sleeve between first and second positions in the housing.

20. The device of claim 17, wherein the internal pressure acts against the second end of the packing seal and moves the first end of the packing seal against the first shoulder of the first sleeve.

21. The device of claim 17, wherein the packing seal assists engagement of the second seal component with the first seal component in response to an external pressure deferential acting outside the first sleeve.

22. The device of claim 21, wherein the external pressure acts against the first end of the packing seal and moves the second end of the packing seal against the second shoulder of the landing; and wherein the external pressure acts against the first shoulder of the first sleeve.

23. The device of claim 17, wherein:

the first seal component comprises a first shelf facing outward and a first ledge extending inward from the first shelf;

the second seal component comprises a second shelf facing inward and a second ledge extending outward from the second shelf; and the first inside and outside shelves define a first minimum flow passage through the seal when the seal is moved between a closed condition and a first opened condition.

24. The device of claim 23, wherein the first and second ledges engage toward one another when the first and second seal components are moved to the closed condition; and wherein the first ledge passes a first of the one or more ports along the axis when distal ends of the first and second shelves meet in the first opened condition.

25. The device of claim 23, wherein a centerline of the packing seal aligns with third shelves extending from the first and second ledges.

26. The device of claim 25, wherein the third shelves define a second minimum flow passage through the first and second seal components when moved to an intermediate condition between the closed condition and the first opened condition.

27. The device of claim 17, further comprising a mechanism moving the second sleeve along the axis of the first sleeve in response to hydraulic pressure.

28. The device of claim 27, wherein the mechanism:

a first piston moving the second sleeve in a first direction in response to first hydraulic pressure, a second piston moving a trigger disposed on the second sleeve in the first direction in response to the first hydraulic pressure, and a catch having a dog engaging in a first slot in the second sleeve and moving in the first direction with the second sleeve.

29. The device of claim 28, wherein the mechanism comprises a first hydraulic port communicating the first hydraulic pressure to the first and second pistons.

30. The device of claim 28, wherein the catch moves to a first stop preventing movement of the second sleeve in the first direction; and wherein the trigger moves to a second stop preventing movement of the trigger.

31. The device of claim 28, wherein in the absence of the first hydraulic pressure, the trigger moves in a second direction opposite to the first direction and disengages the dog from the first slot.

32. The device of claim 31, wherein the catch moves in the second direction until the dog engages in a second slot defined in the second sleeve.

33. The device of claim 28, wherein a first biasing member biases the trigger in the second direction; and wherein a second biasing member biases the catch in the second direction.

34. The device of claim 28, wherein the mechanism moves the second sleeve along the axis of the first sleeve in a second direction opposite the first direction in response to second hydraulic pressure.

* * * * *